US005191770A

United States Patent [19]

Kim

[11] Patent Number: 5,191,770

[45] Date of Patent: Mar. 9, 1993

[54] MOUNTING ASSEMBLY OF A SEPARATE TYPE AIR-CONDITIONER

[75] Inventor: Sung Ki Kim, Suweon-City, Rep. of Korea

[73] Assignee: Samsung Electronics Co., Ltd., Suweon-City, Rep. of Korea

[21] Appl. No.: 808,608

[22] Filed: Dec. 17, 1991

[30] Foreign Application Priority Data

Dec. 17, 1990 [KR] Rep. of Korea ..... 90-20054

[51] Int. Cl.[5] ..... F25D 23/12

[52] U.S. Cl. ..... 62/263; 285/273

[58] Field of Search ..... 62/263, 262, 259.1, 62/297; 285/64, 273, 279, 281

[56] References Cited

U.S. PATENT DOCUMENTS

| | | | |
|---|---|---|---|
| 2,362,698 | 11/1944 | Hull | 62/262 |
| 2,500,852 | 3/1950 | Money | 62/262 |
| 2,594,242 | 4/1952 | Wilson | 285/273 X |
| 2,712,737 | 7/1955 | Palmer | 62/263 |
| 2,732,169 | 1/1956 | Matteo | 285/273 X |
| 2,760,354 | 8/1956 | Brady et al. | 62/262 |
| 4,138,859 | 2/1979 | Pietsch | 62/259.1 X |
| 4,437,690 | 3/1984 | Drath | 285/280 X |
| 4,955,643 | 9/1990 | Bona et al. | 285/281 X |

*Primary Examiner*—William E. Tapolcai

*Attorney, Agent, or Firm*—Burns, Doane, Swecker & Mathis

[57] ABSTRACT

An air conditioner system includes separate indoor and outdoor units affixed to opposite sides of a building wall. A plurality of conduits extend through the wall for transferring heat exchange media and electrical media between the units. Each conduit comprises a hollow first pipe extending through the wall, and two hollow second pipes connected to opposite ends of the first pipe and also connected to a respective unit. A hollow threaded fastener connects each second pipe to its respective first pipe and conducts a fluid between the pipes or houses an electrical wire extending between the pipes.

10 Claims, 4 Drawing Sheets

MOUNTING ASSEMBLY OF A SEPARATE TYPE AIR-CONDITIONER

BACKGROUND OF THE INVENTION

1. Field of the Invention

This invention relates to a mounting assembly of a separate type air conditioner having an indoor evaporator section indoor unit and an outdoor condenser-compressor section outdoor unit, and particularly, to a mounting assembly for affixing the units to opposite sides of a building wall.

2. Prior Art

Generally, a separate air conditioner is known so that an indoor unit is properly mounted on the wall of a room or inside in a building, and an outdoor unit is placed on the ground outside or the balcony of the building. It often requires a longer length for the refrigerant tube and is limited in using the installation space of the indoor and outdoor units.

For example, Japan Patent Laid-Open Publication No. Sho 60-259845 discloses a mounting device of a separate type air conditioner for simplifying the installation work of an indoor unit and enables the outdoor unit to be mounted at low cost without marring the appearance of the titled air conditioner. A tubular projection going through a wall is provided on the indoor unit, opposite to which the hanger of the outdoor unit is mounted through the wall so as to be clamped onto the wall by a bolt.

Japan Patent Laid-Open Publication No. Sho 59-65483 discloses an installation device for a split type air conditioner for improving inside and outside units in their installation appearances and operating efficiency, while facilitating their installation site selection, by installing the inside and outside units oppositely with the wall of house located therebetween, in a household-purpose small air conditioner.

These prior arts also have problems in the installation space and the complexity of the installation device due to the connection relationship between the functions of the indoor and outdoor units and the supporting condition in relation to the wall. Especially, the refrigerant circulation and electrical wired arrangements are not illustrated except for the supporting method of each of the units.

In order to resolve these problems, the object of the present invention is to provide a mounting assembly of a separate type air conditioner simplified in its configuration and free from the installation space.

Another object of the present invention is to provide a mounting assembly for selectively providing the refrigerant circulation, the condensing water drain and the wiring interconnection between the indoor and outdoor units as well as for enabling the indoor and outdoor units to be properly supported on the opposite sides of a building wall.

Still another object of the present invention is to provide a mounting assembly not having an additional tube piercing through the wall for discharging the drain water in an indoor unit.

SUMMARY OF THE INVENTION

According to the present invention, a separate type air conditioner is provided with an indoor unit and an outdoor unit fixed by means of a plurality of mounting assemblies on the opposite sides of a building wall, wherein the mounting assembly comprises a plurality of pipe structures forming a thread portion in a predetermined distance around the inner periphery of both its ends, a circular coupler having a piercing hole through its both sides and a hollow pipe extended from its lower center portion and connected at its other end to the pipe system of the indoor or outdoor unit and a mounting bolt including a fitting portion threaded at its end into the bored hole and a passage portion guiding refrigerant, drain water or electrical wire from the indoor unit or the outdoor unit, and a head portion formed at its upper portion for a wrench, wherein a plurality of the pipe structure extended through a wall with being arranged in a predetermined interval are respectively coupled by means of a mounting bolt with corresponding circular couplers, so that the indoor and outdoor units may be respectively hung up in and outside of a room on the opposite sides of the wall. Herein it is noted that the mounting assembly can provide the refrigerant circulation and the electrical wiring between the indoor and outdoor units. Its design can easily be changed to discharge the drain water outside as desired. Furthermore, its simple configuration is independent of the installation space and facilitates the disassembly, repairs and maintenance to be performed.

The mounting assembly can be used for installing a separate type air conditioner on a house, such as an apartment, which the outdoor installation is limited due to the lack of the available space. The apartment is considered that its outside wall is less restricted in space for mounting the outdoor unit. Also, it generally has a balcony to enable the outdoor unit to be easily mounted on the proper place of the outside wall, in a manner which a plurality of pipe structures. For example four pipes including a refrigerant feeding pipe structure, a refrigerant collecting pipe structure, an electrical wiring pipe structure and a drain water pipe structure, are pierced through the wall to fix the indoor and outdoor units by means of mounting bolts to both their ends cooperating with corresponding couplers, thereby completing the assembly of the separate type air conditioner to be hung up on the wall.

In order to effectively use the mounting assembly, the bored holes in the wall for installing the units are preferably drilled a larger size than the outer diameter of the pipe structure and being horizontal in a straight line. A packing material such as a rubber tube is filled in the bored hole and encompasses the pipe structures so as to dampen the vibration of the compressor mounted in the outdoor unit to the wall. It is preferable to tightly seal the clearances between the pipe structure and the packing material or the packing material and the inner periphery of the bored hole, using adhesive agents, thereby assuring the rigid mounting of the pipe structure to the wall.

On the other hand, the coupler includes a hollow spherical structure integrally fixed to the end part of a vertical or horizontal pipe from the indoor or outdoor unit. It has both sides cut off to form a through hole at its center. Then, on both side sheets there are fixed a sealing gasket made of a rubber, and the mounting bolt is inserted into the through hole to couple the pipe structure with the coupler of the indoor or outdoor unit. The other end of the pipe is attached by means of another coupling to the pipe of the indoor or outdoor unit for the purposes of the refrigerant circulation, the unit's support, the water drain and the electrical wiring.

The mounting bolt is provided with a passage hole formed at the center to guide the refrigerant and drain water flow or the electrical wire from one end to the middle portion of its body. The end portion is provided with a fitting portion forming a thread portion to be threaded into the pipe structure. On the middle portion there is formed a ring shaped groove. A predetermined number of guiding holes are perforated toward the center around the ring shaped groove to communicate with the guiding passage. Therefore, the refrigerant generated from the outdoor unit is passed through the pipe, the spherical coupler, the guiding passage and the pipe structure, in turn, and again through the guide passage, the spherical coupler and another pipe to be supplied to the evaporator of the indoor unit. Then, the refrigerant heat-exchanged at the evaporator cools room air, and the heated refrigerant is returned to the outdoor unit through the contrary path to the air-condition room. Herein, it is noted that the shape of the mounting bolt is not intended to limit the configuration related to the guiding hole, the ring type groove and the guiding passage perforated at the center. For example, the guiding passages may be formed from at least one predetermined place around the fitting portion in a manner to be extended in the form of the horizontal groove from the one end to the ring type groove.

Accordingly, a mounting assembly of a separate type air conditioner facilitates indoor and outdoor units to be mounted on the walls, simultaneously or respectively. After installation, the air conditioner, it is easy to disassemble only the mounting assembly in a manner to draw out a mounting bolt from a pipe structure, so that it is convenient to perform the repair, the maintenance or the cleaning. Also, a pipe structure selectively used as a refrigerant tube, a wiring tube or a condensing water drain is simply arranged in the wall.

BRIEF DESCRIPTION OF THE DRAWINGS

The present invention will be explained in detail below with reference to the accompanying drawings, wherein.

DETAILED DESCRIPTION OF PREFERRED EMBODIMENTS

Figure 1:
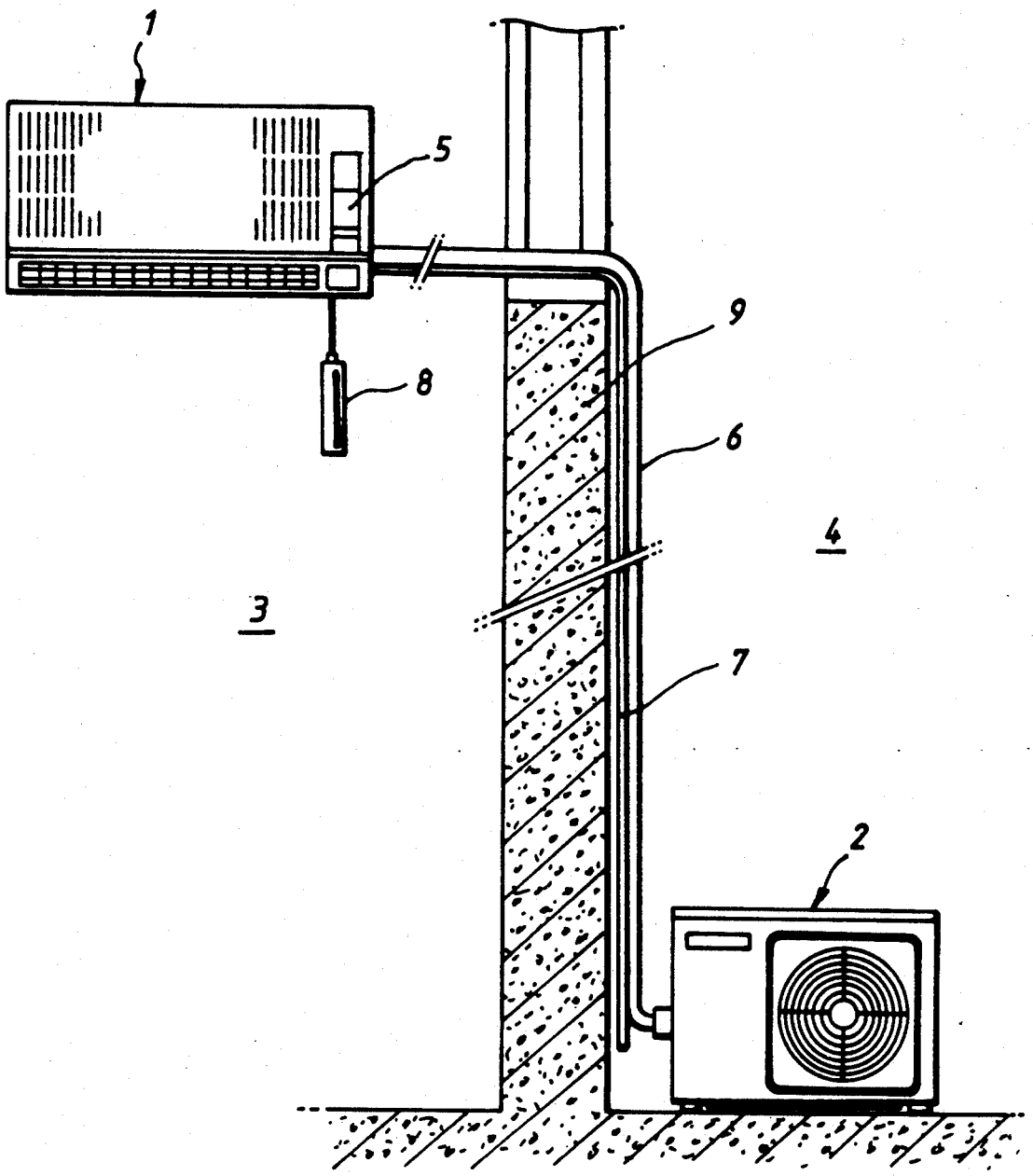
FIG. 1 Prior Art
FIG. 1 is a view illustrating the installation of a separate type air conditioner of the prior art.
Figure 2:
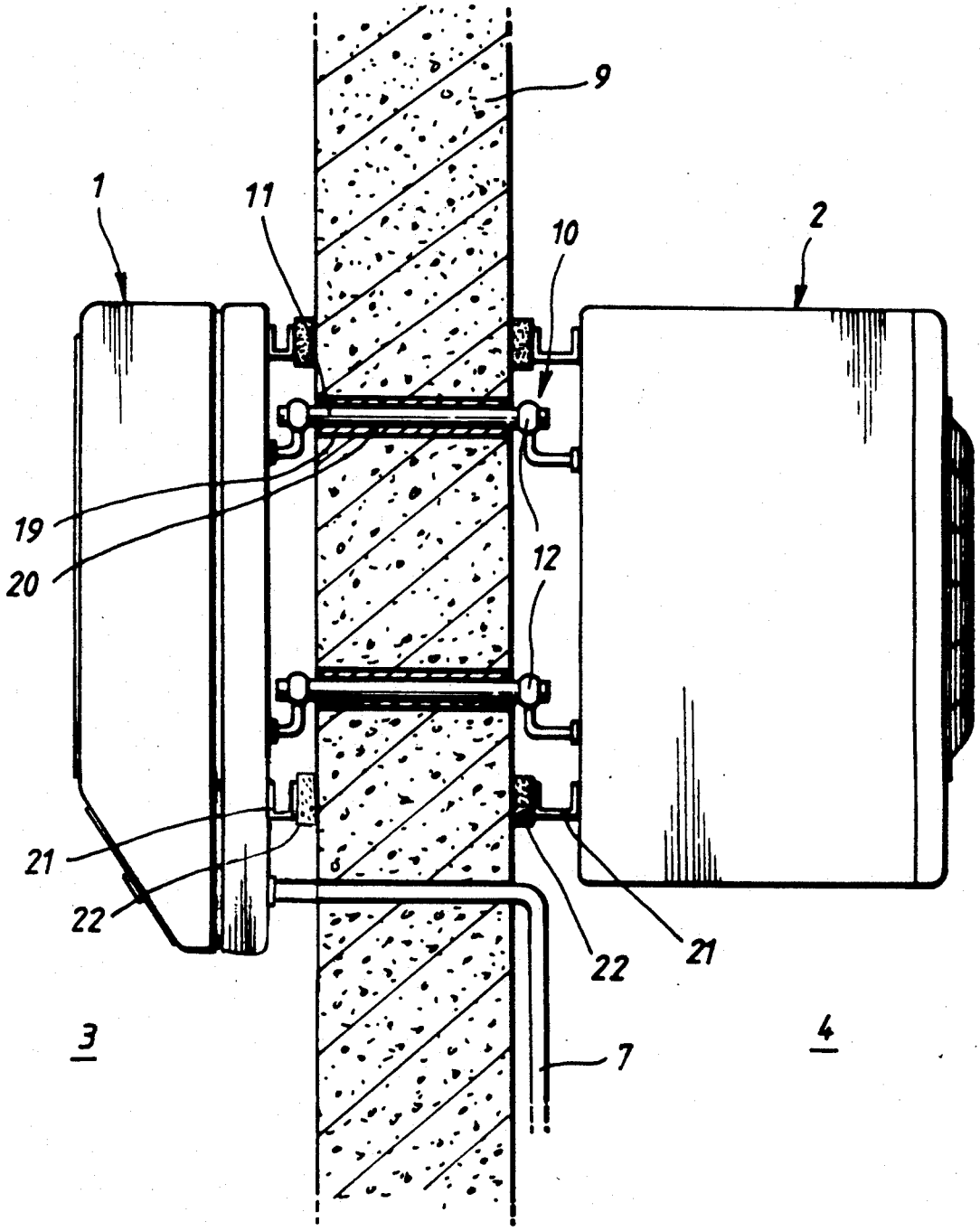
FIG. 2 is a view illustrating the installation of a separate type air conditioner using a mounting assembly according to the present invention.
Figure 3:
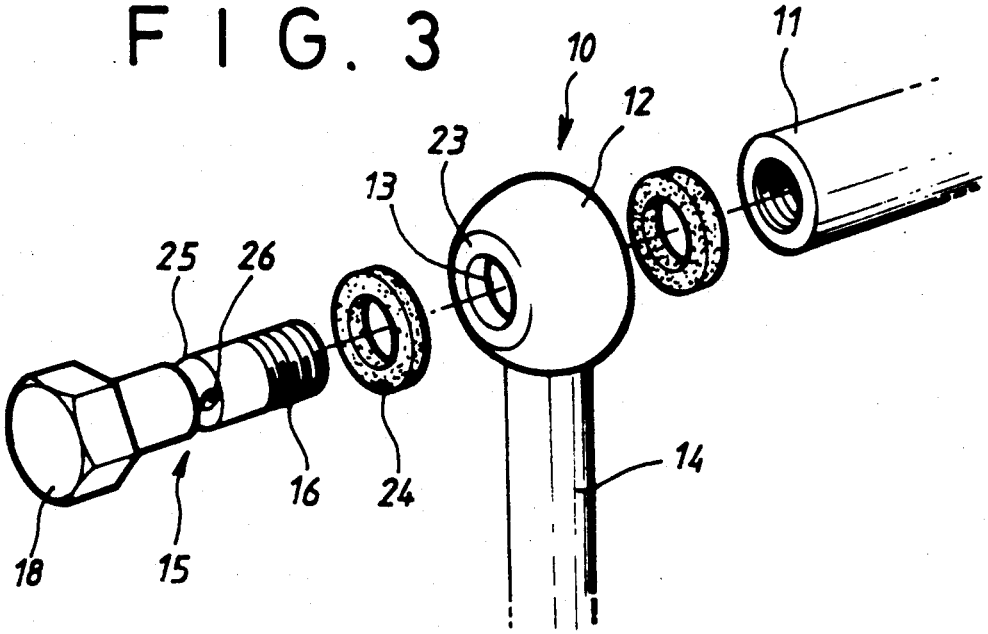
FIG. 3 is an exploded perspective view illustrating a mounting assembly according to the present invention.
Figure 4:
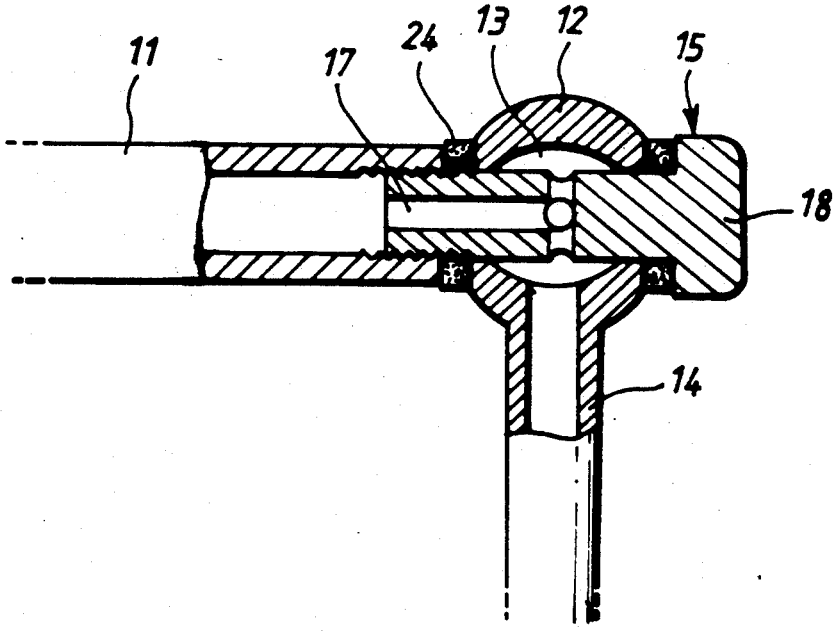
FIG. 4 is a cross-sectional view illustrating the assembly relation of a mounting assembly according to the present invention; and, FIG. 5 is a view illustrating the mechanism connection relation between the indoor and outdoor units of a separate type air conditioner according to the present invention.

Referring to FIG. 1, a separate type air conditioner is provided with an indoor unit 1 mounted in room 3 and an outdoor unit 2 placed on the ground or balcony of the outside environment 4. The indoor unit 1 is provided with an evaporator 27 (see FIG. 5), a motor driven fan for passing cooling air over the evaporator 27, means for collecting and expelling the drain water condensed by the evaporator 27, and an accessible electrical control 5. The outdoor unit is provided with a compressor 28, a condenser 29, a capillary tube 30, a motor driven fan for cooling the refrigerant within the condenser 29. Means for eliminating the drain water expelled by the interior assembly and input and output refrigerant lines are linked to the compressor 28 and condenser 29. The interconnection of the mechanism function between the indoor and outdoor units is accompanied by a flexible conduit 6 which includes flexible tubes for the refrigerant circulation and the flexible electrical wiring. Also, the drain water collecting/expelling means in the indoor unit is connected to a flexible extension tube 7 to enable the drain water to be discharged to the outside 4. A remote control 8 may be installed for a user's convenience while being electrically connected to the electrical control 5. But, the separate type air conditioner requires the installation space of the outdoor unit in the outside 4 as well as the longer flexible conduit 6. Particularly, it is inconvenient to repair, maintain and clean each unit of the separate type air conditioner due to the difficulties in the disassembly of the flexible conduit from the indoor or outdoor unit.

FIGS. 2 through 5 are views illustrating a separate type air conditioner mounting indoor and outdoor units on both opposite sides of a wall and a mounting assembly used for the separate type air conditioner according to the present invention. The same reference numbers are used to indicate identical parts in FIGS. 1–5.

According to the present invention, a mounting assembly 10 comprises a pipe structure 11 forming a thread portion in a predetermined distance around the inner periphery of both of its ends. Connected to each end of the pipe structure is a circular coupler 12 having a drilled hole 13 through both its sides and joined to a hollow pipe 14 extended from the lower center portion of the coupler 12. Each pipe 14 is connected at its other end to the pipe system of the indoor or outdoor unit. A mounting bolt 15 extends through the hole 13 and includes a fitting portion 16 threaded into the end of the pipe structure. The bolt 15 has a passage portion 17 guiding refrigerant, drain water or electrical wire from the indoor unit or the outdoor unit, and a head portion 18 formed at its upper portion for receiving a wrench.

Figure 5:
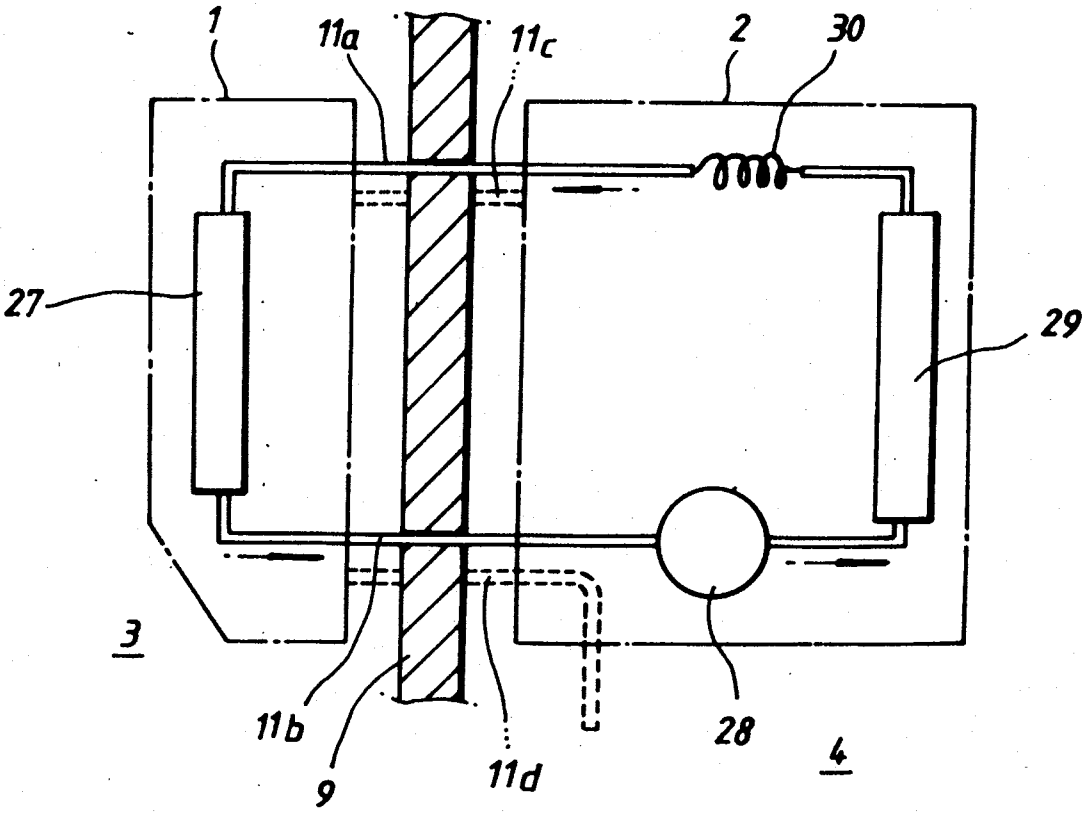

A plurality of the pipe structures 11, for example four pipes including a refrigerant feeding pipe structure **11*a*, a refrigerant collecting pipe structure 11*b*, an electrical wiring pipe structure 11*c* and a drain water pipe structure 11*d* may be extended through a wall 9 while being arranged in a predetermined interval on the proper place of the building wall 9 as seen in FIG. 5. Then, the drilled holes 19 on the wall 9 are preferably drilled in a larger size than the outer diameter of the pipe structure while being horizontal in a straight line. A packing material such as a rubber tube 20 is inserted into the drilled hole 19 while being wrapped around the pipe structures so as to prevent the noise which occurs due to the transferring of vibration from the compressor mounted in the outdoor unit 2 to the wall. Also, the vibration of the compressor may be dampened by mounting a bracket 21 and a vibration absorbent 22 at the predetermined places between the wall 9 and the indoor and/or outdoor units 1 and 2. On the other hand, the drain water tube 11*d* may be substituted for a flexible extension tube 7 piercing through the wall 9**.

The coupler 12 is constituted as a hollow spherical structure integrally fixed to the end part of a vertical or horizontal pipe from the indoor or outdoor unit. It has both side sheets 23 cut off to form a through hole at its center. Then, on both side sheets 23 there are fixed a sealing gasket 24 made of rubber. The coupler 12 may be preferably any one of a union coupler and a socket coupler.

The mounting bolt 15 is provided with a guide passage 17 formed at the center to guide the refrigerant and drain water flow or the electrical wire from one end to the middle portion of its body. The end portion has a fitting portion 16 forming a thread portion to be threaded into the pipe structure. On the middle portion there is formed a ring shaped groove 25. A predetermined number of guiding holes 26 are perforated toward the center around the ring shaped groove 25 to line up with the guiding passage 17. A head portion 18 is formed at the other end of the mounting bolt 15 to fit a wrench.

As a result, the mounting bolt 15 is threaded into the pipe structure 11 to couple with the coupler the pipe 12 of the indoor or outdoor units 1, 2. The pipe 14 integrally extended from the other end of the coupler 12 is attached by means of another coupling to the pipe of the indoor or outdoor unit for the purposes of a media transfer, e.g., the refrigerant circulation, the unit's support, the water drain and the electrical wiring. In this manner, all pipe structures 11 are respectively coupled by means of the mounting bolts 15 with corresponding circular couplers 12, so that the indoor and outdoor units 1, 2 may be respectively hung up on the opposite sides of the wall in room 3 and outside 4. Herein, it is noted that the mounting assembly can provide the refrigerant circulation and the electrical wiring between the indoor and outdoor units. It can easily change its design to discharge the drain water outside as desired.

Accordingly, a mounting assembly of a separate type air conditioner facilitates indoor and outdoor units to be mounted on the walls, simultaneously or respectively. After installation, the air conditioner is easy to disassemble by only removing the mounting assembly in a manner to draw out a mounting bolt 15 from a pipe structure 11 so that it is convenient to perform repairs, maintenance or cleaning. Also, a pipe structure selectively used as a refrigerant tube, a wiring tube or a condensed water drain tube are simply embedded in the wall to lead to the effective use of space as well as to improve the appearance of the air conditioner which gives an aesthetic feeling to its various views.

What is claimed is:

1. In an air conditioner system including:

an indoor unit and a separate outdoor unit disposed on opposite sides of a building wall and situated above a floor and the ground, respectively; and at least three conduit means interconnecting said indoor and outdoor units for the transfer of media therebetween and for supporting said indoor and outdoor units above said floor and said ground, respectively, each of said conduit means comprising:

a hollow first pipe extending through the building wall such that each first pipe has an indoor end and an outdoor end, a pair of hollow second pipes disposed at respective ends of said first pipe, each second pipe including a coupling portion connected to said end first pipe, and a conducting portion extending from said coupling portion, and connecting means for removably securing said second pipes to said first pipe such that a passage is formed which communicates the interior of said first pipe with the interior of said second pipes;

said indoor unit being connected to, and supported by, each of said second pipes located at said indoor end of its respective first pipe;

said outdoor unit being connected to, and supported by, each of said second pipes located at said outdoor end of its respective first pipe;

two of said conduit means conducting a medium in the form of heat transfer fluid between said indoor and outdoor units such that the fluid contacts interior surface of said first pipe and said second pipe of said two conduit means; and a third of said conduit means containing an electrical wire for conducting medium in the form of electricity between said indoor and outdoor units.

2. Apparatus according to claim 1, wherein said conduit means includes a fourth conduit means for conducting drainage water away from said indoor unit.

3. A separate type air conditioner system according to claim 1, wherein said connecting means comprises a removable fastener extending through a hole in said coupling portion and being connected to said end of said first pipe, said fastener forming said passage.

4. A separate type air conditioner system according to claim 3, wherein said fastener is threadedly connected to said end of said first pipe.

5. A separate type air conditioner system according to claim 4, wherein said end of said first pipe is internally threaded, and said fastener is externally threaded.

6. A separate type air conditioner system according to claim 3, wherein said fastener includes a head situated outside of said coupling portion to be turned by a tool.

7. A separated type air conditioner system according to claim 3, wherein a portion of said fastener connected to said first pipe forms a first section of said passage communicating with the interior of said first pipe, said fastener including a second passage section with the communicating with said first passage section interior of said second pipe.

8. A separate type air conditioner system according to claim 7, wherein said portion of said fastener is threadedly connected to said first pipe and is hollow to define said first passage section.

9. A separate type air conditioner system according to claim 3, wherein said coupling portion is of generally spherical shape.

10. A separate type air conditioner system according to claim 1, wherein each of said conduit means includes a packing material disposed in said wall and encompassing said first pipe.

* * * * *